US010317141B2

(12) United States Patent
Vestergaard et al.

(10) Patent No.: US 10,317,141 B2
(45) Date of Patent: Jun. 11, 2019

(54) MULTI PORT EXTRUSION TUBING DESIGN

(71) Applicant: SAPA AS, Oslo (NO)

(72) Inventors: Bjørn Vestergaard, Aabenraa (DK); Ole Ploug, Roedekro (DK)

(73) Assignee: HYDRO EXTRUDED SOLUTIONS AS, Oslo (NO)

( * ) Notice: Subject to any disclaimer, the term of this patent is extended or adjusted under 35 U.S.C. 154(b) by 0 days.

(21) Appl. No.: 15/529,789

(22) PCT Filed: Nov. 25, 2015

(86) PCT No.: PCT/EP2015/077657
§ 371 (c)(1),
(2) Date: May 25, 2017

(87) PCT Pub. No.: WO2016/083457
PCT Pub. Date: Jun. 2, 2016

(65) Prior Publication Data

US 2017/0314862 A1 Nov. 2, 2017

(30) Foreign Application Priority Data

Nov. 25, 2014 (SE) ..... 1451424

(51) Int. Cl.
*F28F 1/02* (2006.01)
*B21C 23/08* (2006.01)
*F28D 1/047* (2006.01)

(52) U.S. Cl.
CPC ..... *F28D 1/047* (2013.01); *B21C 23/085* (2013.01); *F28D 1/0476* (2013.01);
(Continued)

(58) Field of Classification Search
CPC ..... F28D 1/047; F28D 1/0476; F28D 1/0478; F28D 1/0246; F28D 1/04; B21C 23/085;
(Continued)

(56) References Cited

U.S. PATENT DOCUMENTS 3,416,600 A * 12/1968 Fink ..... F28D 1/0478 165/175
9,891,007 B2 * 2/2018 He ..... F28F 1/025
(Continued)

FOREIGN PATENT DOCUMENTS

CN 102748964 10/2012
JP 2891523 5/1999
(Continued)

OTHER PUBLICATIONS

Chinese Office Action dated Aug. 29, 2018 in Chinese Patent Application No. 201580064161.X with English translation.
(Continued)

*Primary Examiner* — Justin M Jonaitis
(74) *Attorney, Agent, or Firm* — Wenderoth, Lind & Ponack, L.L.P.

(57) ABSTRACT

A Multi Port Extrusion tubing (MPE tubing) (10) made from a Multi Port Extrusion (MPE), the MPE being a web like extrusion (Web-MPE) with two or more individual tubes (8) interlinked with webs (9). The webs have a thickness, which is less than the tube diameter of the individual tubes, and the MPE tubing includes at least one bending zone (A), and at least two straight zones (C1, C2). The web-MPE in the bending zone (A) is bent so that each individual tube has a U-shape, and the web-MPE in a first straight zone (C1) is parallel to the web-MPE in an adjacent second straight zone (C2). The web-MPE in the straight zones on each side of the bending zone (A) extend in substantially the same plane, so that all individual tubes of the web-MPE in the straight zones are parallel to each other, and extend in the same plane.

14 Claims, 6 Drawing Sheets

(52) U.S. Cl.
CPC ..... *F28D 1/0478* (2013.01); *F28F 1/02* (2013.01); *F28F 1/022* (2013.01); *F28F 2255/16* (2013.01)

(58) Field of Classification Search
CPC ..... F28F 1/02; F28F 1/022; F28F 2255/16; F28F 1/00; F28F 9/013; F28F 1/10; F28F 13/003; F28F 13/02; F28F 13/08; F28F 1/14; F28F 1/38
USPC ..... 165/177, 178, 181, 182, 183, 152, 172
See application file for complete search history.

(56) References Cited

U.S. PATENT DOCUMENTS

D828,910 S * 9/2018 Huan ..... D23/323
2002/0121120 A1* 9/2002 Kraft ..... B21C 23/085 72/254
2006/0243432 A1* 11/2006 Demuth ..... F28D 1/0476 165/176
2008/0173434 A1* 7/2008 Matter ..... F28D 1/0417 165/150
2008/0302518 A1 12/2008 Durdel et al.
2011/0024779 A1 2/2011 Nakamura et al.
2011/0139425 A1* 6/2011 Beamer ..... F28D 1/0476 165/175
2011/0247791 A1* 10/2011 Jiang ..... F28D 1/047 165/173
2014/0366571 A1* 12/2014 Gao ..... F25B 39/02 62/498
2015/0168071 A1* 6/2015 Gao ..... B23P 15/26 165/151
2017/0276433 A1* 9/2017 Avila ..... F28D 1/0246

FOREIGN PATENT DOCUMENTS

WO 03/085347 10/2003
WO 2004/074756 9/2004
WO 2014/133394 9/2014
WO 2014/137217 9/2014
WO WO-2014133394 A1 * 9/2014 ..... F28D 1/047

OTHER PUBLICATIONS

International Search Report dated Feb. 12, 2016 in International (PCT) Application No. PCT/EP2015/077657.

* cited by examiner

Fig 1 (Prior art)
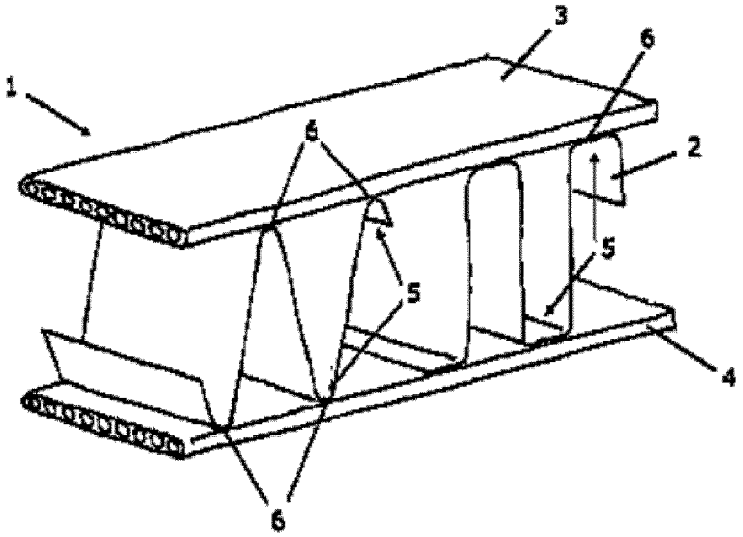
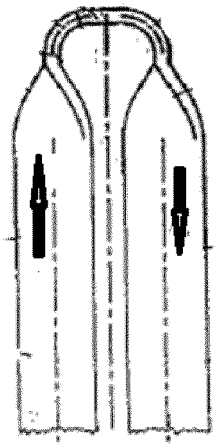
Fig 2a (Prior art)
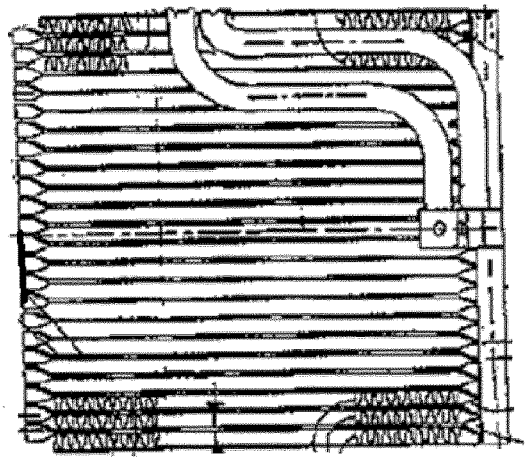
Fig 2b (Prior art)
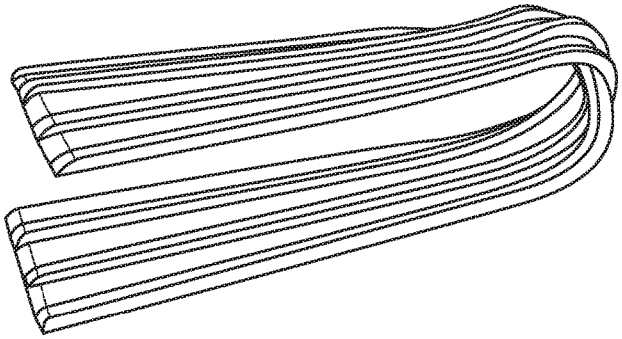
Fig. 2c (Prior art)

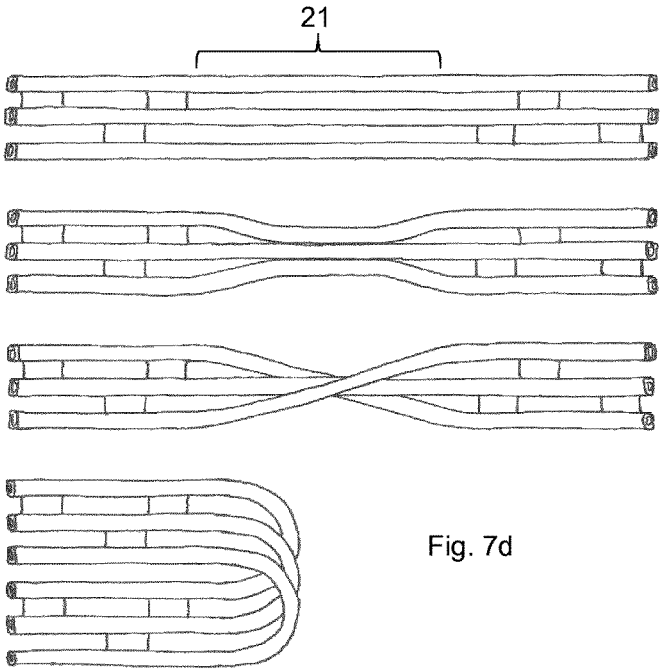
Fig. 7a
Fig. 7b
Fig. 7c
Fig. 7d
Fig. 7
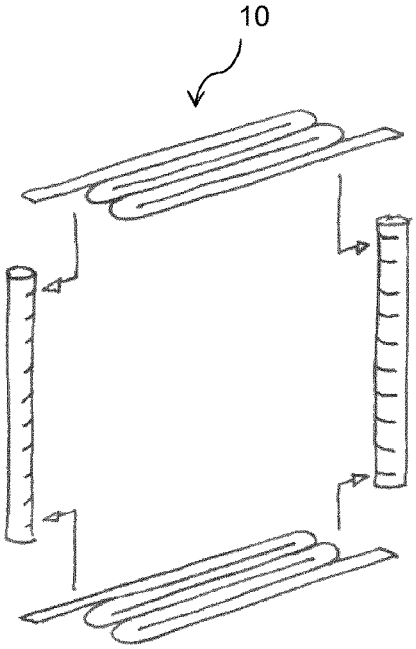
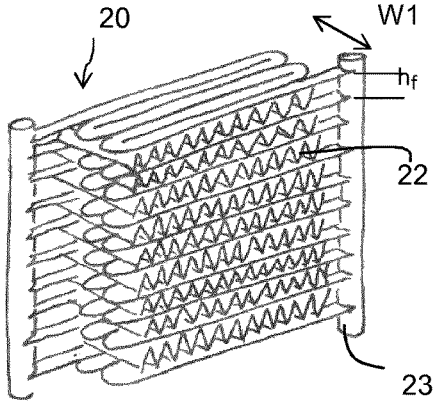
Fig. 8

MULTI PORT EXTRUSION TUBING DESIGN

TECHNICAL FIELD

The present invention relates to a new design related to Multi Port Extrusion tubings, so-called MPE tubings, for use in exchangers for heat exchange or heat recovery in solutions such as refrigeration or heat pump systems, in particular a condenser, gas cooler or evaporator in such systems, methods of producing the Multiport Extrusion tubing (MPE tubing), a heat exchanger comprising the MPE tubing and a method of producing the heat exchanger.

BACKGROUND

Micro channel type heat exchangers based on multiport extruded profiles of aluminium are known where fins, also of aluminium, are provided between the extruded tubes or channels. Heat exchangers of this type are for instance known from WO2014133394.

WO03085347 describes a heat exchanger comprising multiport extruded tubes including a U-shaped bend having a straight section of tubing extending between two curved sections of tube, a first twist connecting one of the tube runs to one of the curved sections of the U-shaped bend, and a second twist connecting the other tube run to the other curved section of the U-shaped bend. A limitation with this heat exchanger design is the large volume in the bending area. This volume does not contribute to the capacity of the heat exchanger. With the bending concept described in WO03085347 it is not possible to use a MPE width larger than the fin height (the distance between two MPEs). Another method for producing heat exchangers is known from US20110247791. A limitation with the prior art multiport extrusion heat exchangers are that they cannot be adapted to designs with high demands on design optimization.

The patent JP2891523 describes a bent MPE where a multiport extrusion is bent 90 degrees in the width direction. When classic MPEs are bent in this way it is done in a tool that only can support the tube on the outside. It is not practically possible to insert mandrels in the tiny ports. The bending radius is by this limited to be several times larger than the profile width. The outer bending radius will lose thickness due to elongation. This manufacturing process is very complicated and requires time and tooling. It also does not give freedom of design to different shape requirements as small bending radiuses are difficult to achieve. The present invention overcomes the above limitations.

SUMMARY OF THE INVENTION

The present invention relates to a Multi Port Extrusion tubing (MPE tubing) made from a Multi Port Extrusion (MPE), said MPE being a web like extrusion (Web-MPE) with two or more individual tubes interlinked with webs, said webs having a thickness, which is less than the tube diameter of the individual tubes. The MPE tubing comprises at least one bending zone, and at least two straight zones, wherein the web-MPE in the bending zone is bent so that each individual tube of the web-MPE has a U-shape, and the web-MPE in a first straight zone is parallel to the web-MPE in an adjacent second straight zone, the web-MPE in the straight zones on each side of the bending zone extend in substantially the same plane, so that all individual tubes of the web-MPE in the straight zones are parallel to each other, and extend in the same plane, and the individual tubes in the at least one bending zone cross each other. The MPE tubing typically has a height ($h_t$) of <10 mm.

The web-MPE in said straight zones is preferably positioned on each side of a line X-X extending along, and parallel to, the web-MPE in the straight zones, and wherein the innermost individual tube of each straight zone, which is closest to the line X-X, are in parallel relationship at a center-to-center distance $B_2$ from each other, which distance $B_2$ is approximately equal to, or less than, the diameter of the individual tubes, preferably 0.01-1 mm.

The web-MPE of the MPE tubing may preferably have been twisted around its length axis (L) before being bent, such that the web-MPE in the second straight section is twisted 180° in relation to the web-MPE in the adjacent first straight section), whereby the individual tubes in the first straight section have a sequence a-b-c-d before the bending zone and a sequence d-c-b-a after the bending zone, or the individual tubes in the first straight section have a sequence a-b-c-d before the bending zone and a sequence a-b-c-d after the bending zone.

The invention also relates to an MPE tubing made from a Multi Port Extrusion (MPE), said MPE being a web like extrusion (Web-MPE) with two or more individual tubes interlinked with webs, said webs having a thickness, which is less than the tube diameter of the individual tubes, and comprising at least one bending zone, and at least two straight zones, wherein the web-MPE in the bending zone is bent 90° twice, the web-MPE thereby being bent in total 180°, so that the individual tubes cross each other twice in the bending zone, and that the web-MPE in a first straight zone is parallel to the MPE in an adjacent second straight zone, the web-MPE in the straight zones on each side of the bending zone extend in substantially the same plane, so that all individual tubes of the web-MPE in the straight zones are parallel to each other, and extend in the same plane.

The invention also relates to a method of producing the first described MPE tubing, comprising the steps of a) tearing or removing parts of the web-MPE tube interlinking web in a zone which will become the bending zone; b) bending the web-MPE around its width axis (Y-Y) so that a U-shaped loop is formed having a straight upper part and a straight lower part; c) sliding the upper part of the bent web-MPE relative to the lower part so that the straight upper and lower parts of the web-MPE end up in parallel relationship and become located in the same plane, while the individual tubes cross each other in the bending zone.

The steps a) and b) may be repeated by bending the web-MPE in alternating opposite directions until a serpentine web-MPE comprising alternating straight zones and bending zones is formed. Further, the method may comprise before step b) gathering of the individual tubes in the zone, which will subsequently become the bending zone, so that the distance between the individual tubes is decreased, and then twisting the web-MPE 180° around its length axis. The method may also comprise twisting the MPE tubing around its length axis (L) followed by bending it around the tube height axis (Z-Z).

The invention also relates to a method of producing the second MPE tubing described above. The method comprises forming a bending zone by folding the web-MPE approximately 90° to the extrusion direction, and then folding again approximately 90° in the same direction as the previous fold, so that the web-MPE is folded in total 180°, whereby a folded tube design with individual tubes crossing each other twice is formed.

The folding steps may be repeated by bending the web-MPE in alternating opposite directions until a serpentine MPE tubing is formed, so that two or more bending zones are obtained.

The invention also relates to a heat exchanger comprising at least one MPE tubing as described above. The heat exchanger may further comprise fins having a height $h_f$ attached to the MPE tubing, and where the MPE tubing has a width, which is larger than the fin height, preferably at least twice the fin height.

The invention also relates to a method of producing the above described heat exchanger, wherein the two or more MPE tubings are produced as a flat serpentine, comprising at least one bending zone, and assembled with multiple alternating rows of fins and thereafter brazed.

The invention also relates to a method of producing the above heat exchanger comprising tearing or removing parts of the web-MPE tube interlinking web in a zone which will become the bending zone (A); assembling two or more web-MPE's with alternating rows of fins and thereafter brazed to form a straight heat exchanger element, bending the heat exchanger element around the height axis (Z-Z) in the bending zones (A).

With the present invention is provided an improved MPE design which utilizes the benefits of MPE production technology, provides a heat exchanger with improved cooling capacity, and gives improved design options.

The invention is characterized by the features as defined in the appended claims.

BRIEF DESCRIPTION OF THE DRAWINGS

The invention will be further described in detail in the following by means of examples and with reference to the attached drawings, where:

FIG. 1 shows in perspective view part of a commonly known MPE based heat exchanger with a serpentine fin assembly;

FIG. 2*a, b* shows in perspective a twisted and bent serpentine MPE tubing according to the prior art, FIG. 2*c* shows another twisted MPE tubing according to the prior art;

FIG. 7*a-d* shows that the tubes a, b and c that have been twisted, for instance 180°, before bending and sliding the tube parts relative each other to form the flat MPE tubing according to the invention;

FIG. 8 shows the manufacturing of an MPE tubing produced as a flat serpentine and assembled with multiple alternating rows of fins and thereafter inserted into headers and brazed;

DETAILED DESCRIPTION OF THE INVENTION

Figure 3:
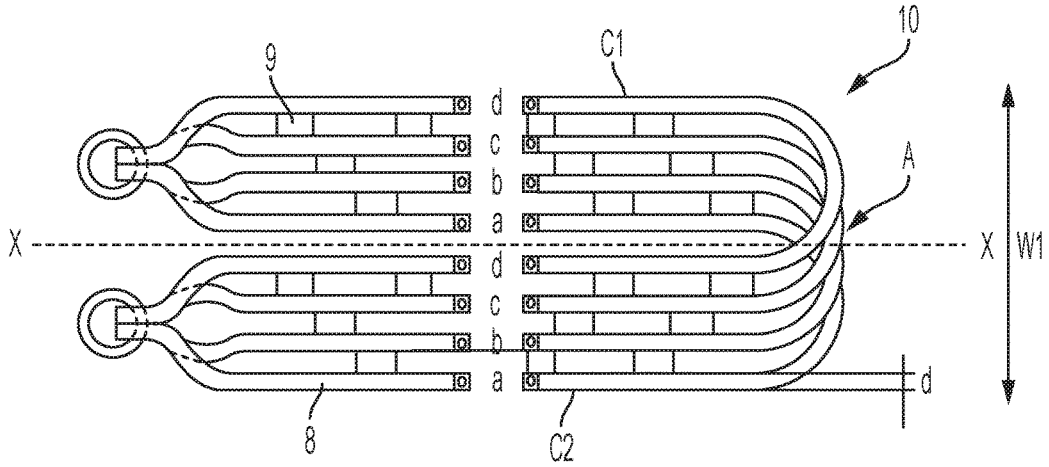
FIG. 3 shows a perspective view part of a MPE tubing according to the invention.

The present invention provides an improved heat exchanger with an inlet and outlet design where a more compact heat exchanger design with maintained/improved capacity can be produced.

The present invention relates to a flat Web-Multi Port Extrusion tubing (MPE tubing) for use as a heat exchanger component in heat exchangers. A Web-Multi Port Extrusion is a web-like extrusion (web-MPE) with two or more individual tubes interlinked with webs. The use of Web-MPE in the MPE tubing is advantageous, since it is an effective way of providing a plurality of tubes which are held together in parallel orientation, and allows easy production. By producing a heat exchanger component, such as the MPE tubing of this application, from a web-MPE, it can be formed in one piece, which leads to a robust component, which is easy to manufacture and has improved heat transfer properties. The web-MPE has a length direction (L), which corresponds to the extrusion direction, a width direction perpendicular to the length direction, and a height direction. A width axis (Y-Y) is directed in the width direction. In the web-MPE, the individual tubes and the interlinking webs are alternately arranged in the width direction (Y-Y). The interlinking webs are flat solid portions of extruded metal, which are integrally extruded in one piece together with the individual tubes, and have a thickness in the height direction, being less than the diameter of the individual tubes. The MPE tubing comprises at least one bending zone (A), and at least two straight zones (C1, C2), at least one bending zone (A), and at least two straight zones (C1, C2), wherein the web-MPE in the bending zone (A) is bent so that each individual tube (8) of the web-MPE has a U-shape, and that the web-MPE in a first straight zone (C1) is parallel to the web-MPE in an adjacent second straight zone (C2), the web-MPE in the straight zones (C1, C2) on each side of the bending zone (A) extend in substantially the same plane, so that all individual tubes (8) of the web-MPE in the straight zones are parallel to each other, and extend in the same plane, and the individual tubes in the at least one bending zone cross each other. The MPE tubing will be substantially flat since the web-MPE in all straight zones extend in substantially the same plane. Thereby, the MPE tubing will have a large heat transfer surfaced in relation to its volume.

The individual tubes of adjacent straight zones are in parallel relationship at a center-to-center distance $B_2$ from each other. The parallel tubes of the straight zones on each side of the bending zone are thus in substantially the same plane, and the individual tubes in the at least one bending zone cross each other. In the bending zone, the individual tubes will thus be sheared sideways so that they end up in an overlapping relationship, so that the MPE tubing becomes relatively flat also in the bending zone. The interlinking webs are partly torn or removed, at least in the bending zone (A), order to facilitate bending of the web-MPE.

The height ($h_t$) of the flat web-MPE in the MPE tubing comprising alternating bending zones and straight zones is preferably <10 mm.

The web-MPE in said straight zones (C1, C2) is preferably positioned on each side of a line X-X extending along, and parallel to, the web-MPE in the straight zones, and wherein the innermost individual tube (8', 8") of each straight zone (C1, C2), which is closest to the line X-X, are in parallel relationship at a center-to-center distance B2 from each other, which distance B2 is approximately equal to, or less than, the diameter of the individual tube, preferably 0.01-1 mm. Said line X-X is parallel to the length direction (L) of the web-MPE before bending. The distance $B_2$ thus relates to the distance between adjacent straight zones on each side of a bending zone. The present invention allows the straight zone portions (C1, C2) of the flat MPE-tubing to lie closely side by side, so that the distance $B_2$ is close to zero.

The flat MPE tubing may be bent such that their relative order is the same on each side of the bending zone, for example, if the web-MPE comprises four individual tubes (a, b, c, d), the sequence of the individual tubes before and after the bending zone, respectively will be a-b-c-d/a-b-c-d. Alternatively, the flat MPE tubing may be twisted and then bent such that their relative order is the opposite on each side of the bending zone, so that the sequence of individual tubes (a, b, c, d), before and after the bending zone, respectively, will be a-b-c-d/d-c-b-a. Thus, the individual tubes (8) (in the first straight section (C1) may have a sequence a-b-c-d before the bending zone, and a sequence d-c-b-a after the bending zone, obtained by twisting the web-MPE around its length axis (L) before being bent, such that the web-MPE tubing in the second straight section (C2) is turned 180° in relation to the web-MPE tubing in the adjacent first straight section (C1).

The MPE tubing preferably comprises two or more bending zones, more preferably 2-4 bending zones. By including two or more bending zones the web-MPE will run forwards and backwards in a serpentine manner, allowing an increased surface area of the MPE tubings.

The present invention also relates to a method of producing the above described flat MPE tubing, comprising the following steps:

a) tearing or removing parts of the web-MPE tube interlinking web (9) in a zone which will become the bending zone;
b) bending the web-MPE around its width axis (Y-Y) so that a U-shaped loop is formed having a straight upper part (C1) and a straight lower part (C2);
c) sliding the upper part (C1) of the bent web-MPE relative to the lower part (C2) so that the straight upper and lower parts of the web-MPE end up in parallel relationship and become located in the same plane, while the individual tubes (8) cross each other in the bending zone.

Steps a) and b) may be repeated by bending the web-MPE in alternating opposite directions until a serpentine web-MPE, comprising alternating straight zones and bent zones, is formed. The final MPE tubing will thereby comprise two or more bending zones and three or more straight portions of web-MPE.

Before step b) above, the individual tubes in the zone, which will subsequently become the bending zone, may be gathered so that the distance between the individual tubes is decreased, and thereafter twisted around its length axis so that the straight zone after the twist is turned 180°.

Alternatively, the MPE tubing may be obtained obtained by twisting the web-MPE, followed by bending it around the tube height axis Z-Z, which is perpendicular to the width axis X-X and the length direction (L). the method may then comprise the steps of a) tearing or removing parts of the web-MPE tube interlinking web (9) in a zone which will become the bending zone; b) gathering the individual tubes (8) in the zone, which will subsequently become the bending zone (A), so that the distance between the individual tubes is decreased, and then twisting the MPE 180° around its length axis (L); c) bending the MPE around its height axis (Z-Z) so that the straight parts C1, C2 end up in parallel relationship;

The folding steps may be repeated by bending in alternating opposite directions until a serpentine MPE tubing is formed.

Figure 9:
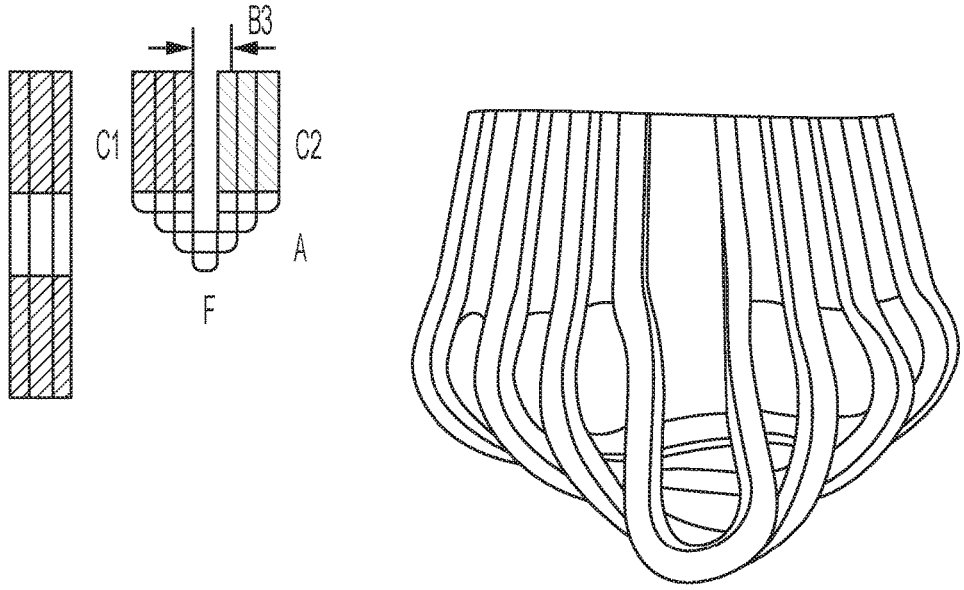
FIG. 9 shows an alternative way of manufacturing the MPE tubing according to the invention.

Alternatively, the above described flat MPE tubing may be produced by a method in which a bending zone is formed by folding the web-MPE approximately 90° to the extrusion direction, and then folding again approximately 90° in the same direction as the previous fold, so that the web-MPE is folded in total 180°, whereby a folded tube design (F) with individual tubes crossing each other twice is formed (see FIG. 9). The folding steps may be repeated by bending in alternating opposite directions until a serpentine MPE is formed. Parts of the web-MPE tube interlinking web (9) can be teared or removed in a zone which will become the bending zone (A). The MPE tubing obtained by this method comprises at least one bending zone, in which the individual tubes of the web-MPE are bent 90° twice, so that the individual tubes cross each other twice in the bending zone, and that straight web-MPE portions are positioned parallel to each other on each side of the bending zone.

The present invention also relates to a heat exchanger comprising one or more of the above described flat MPE tubing. The heat exchanger may preferably comprise fins having a height ($h_f$) attached to the MPE tubing, and the MPE tubing may have a width (W1), which is larger than the fin height ($h_f$), preferably at least twice the fin height ($h_f$). The heat exchanger preferably comprises two or more MPE tubings, arranged on top of each other and with rows of fins positioned between each MPE tubing.

The heat exchanger may be produced by assembling a plurality of flat MPE tubings alternating with alternating rows of fins, and brazing thereof.

FIG. 1 shows a part of a commonly known MPE based heat exchanger according to the prior art with a serpentine fin assembly 1. The serpentine fin 2 of the heat exchanger is provided in the longitudinal direction between the multi tube extrusions 3, 4 and is attached to the extrusions at the outer faces of the fin crests or bends 5, 6 by means of the brazing. A heat exchanger of this type is normally composed of a number of such extrusions, with "layers" of fins and extrusions (one above the other/ parallel flow).

FIG. 2 shows another example of a prior art design. The tubing has been formed by twisting of the web-MPE 90° and bending of the tube, and then twisting it back again so as to form a U-shaped MPE-tubing (FIG. 2*a*). The thickness of the tubing after bending will be the same as the tube width outside the bent portion, due to the twisted section. FIG. 2*b* shows a heat exchanger comprising the tubing of FIG. 2*a* seen from the side. FIG. 2*c* shows a prior art twisted MPE tubing made according to a method mentioned in WO2014/133394.

FIG. 3 shows a MPE tubing 10 in the form of a flat web-multiport extrusion (MPE) tubing according to the invention. This design creates a possibility for bends down to an inner bending radius of almost 0. The MPE is a web-MPE with tubes 8 interlinked with webs 9 having a thickness less than the tube diameter ($d_1$), see also FIG. 5. The MPE tubing shown in FIG. 3 has a bending zone (A), in which the individual tubes are bent to a U-shape and cross each other, and two straight zones C1, C2, where the individual tubes 8 are in parallel relationship, and which extend in substantially the same plane . In this example the individual tubes a, b, c, d have the same sequence before and after the bending zone. FIG. 3 shows a MPE tubing having one bending zone, but the MPE can advantageously be bent such that two or more bending zones are obtained, whereby the MPE attains a serpentine-like configuration.

Figure 4A:
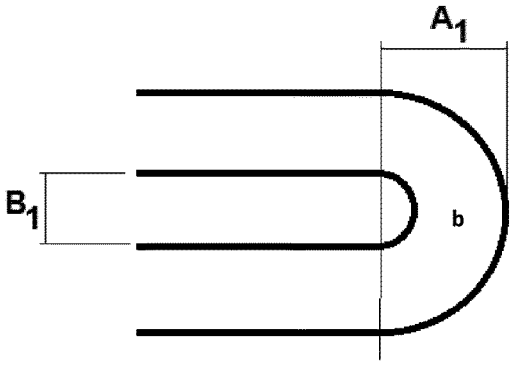
Fig. 4a (Prior Art)
FIG. 4 shows a comparison between a Web-MPE tubing according to a prior art solution (4*a*) with a Web-MPE tubing bent according to the invention (4*b*)
FIG. 4*c* shows a side view of the design of FIG. 4*b;*
Figure 4B:
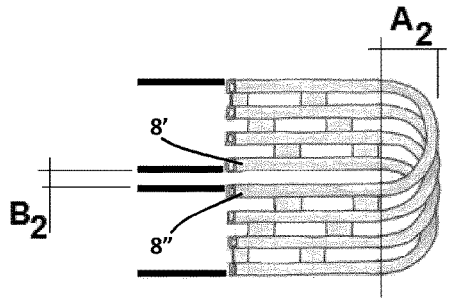
Figure 4C:
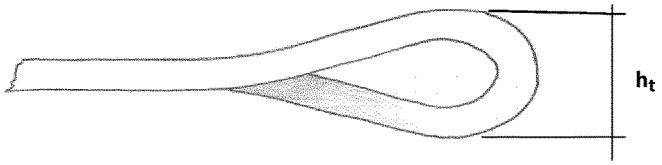

A comparison between an MPE design according to the prior art (FIG. 4*a*) with a Web-MPE tubing according to the invention (FIG. 4*b*) shows that the total external volume of the heat exchanger may be reduced by use of the design according to the present invention. In the design shown in FIG. 4*a*, both the bending zone A1 and the distance B1 between the straight MPE portions before and after the bending zone is relatively large. The space used for bending (A1,A2) is a space typically not utilized for heat transfer, and it is therefore advantageous to have a small bending zone. It is clear from the drawing that the volume is smaller with the design according to the invention. Also the spacing between the tube sections (B1,B2) is smaller with the present invention, since the way of bending allows the straight portions to lie close to each other. This gives a more efficient cooler per volume, i.e. a more efficient usage of the space available. It is also possible to make the tubing almost flat, while the prior art design is more 3-dimensional (see FIG. 2*b*). The flat Web-MPE tubing height ($h_t$) is preferably <10 mm (FIG. 4*c*).

The present invention may be used for parallel flow heat exchangers or in hybrid solutions where flat bent MPEs are bent into serpentines.

Figure 5:
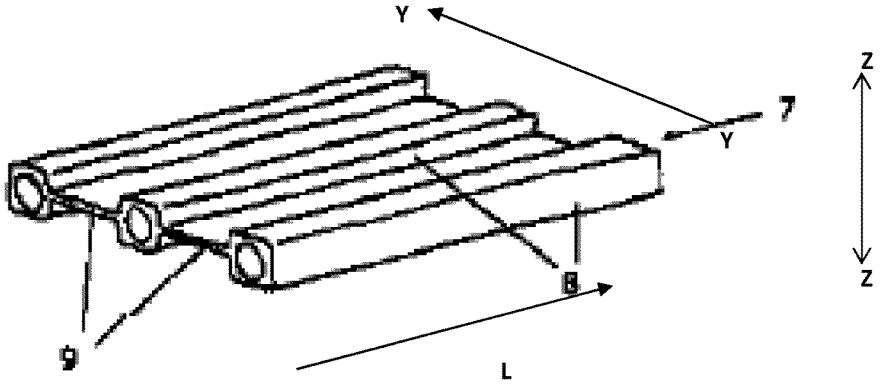
FIG. 5 shows a web-MPE according to the invention with "individual" tubes (8) or micro channels (7) interlinked with thinner flanges or webs (9)

An example of a web-like extrusion (Web-MPE) with individual tubes or micro channels (8) interlinked with thinner flanges or webs (9), which may be used for the present invention, is shown in FIG. 5. The MPE preferably comprises three or more tubes, more preferably 3-20 tubes. The flow direction (7) through the individual tubes is also shown in FIG. 5. A part of the interlinking flanges or webs of the MPE tubing may be removed after extrusion, such as by roller punching or tearing, in particular in the bending zone.

Figure 6A:
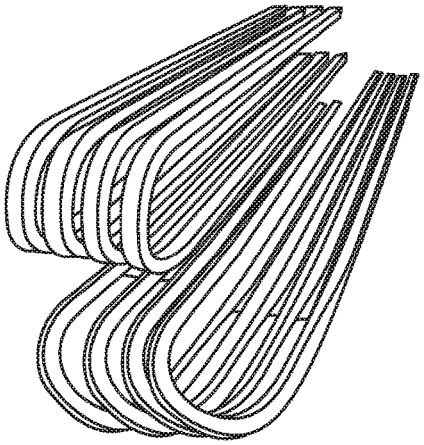
FIG. 6*a-c* shows a photograph of web-MPE tubings according to the invention.

FIG. 6*a* shows how the flat serpentine MPE tubing according to the invention can be manufactured. First the Web-MPE straight tube is bent around the width axis (Y-Y in FIG. 5) in order to form a U-shaped tube. Then the tube parts are slid sidewise relative to each other until the straight portions of the MPE lie side by side in substantially the same plane. The sliding can also take part in combination with the bending process so that after each bend the MPE is slid to the side and then the next bend is made in the opposite direction. Bending and sliding may be repeated a desired number of times, while each bend is made in the opposite direction until a serpentine Web-MPE is formed. The individual tubes (8) in the first straight section (C1) have a sequence a-b-c-d before the bending zone and a sequence a-b-c-d after the bending zone.

Figure 6B:
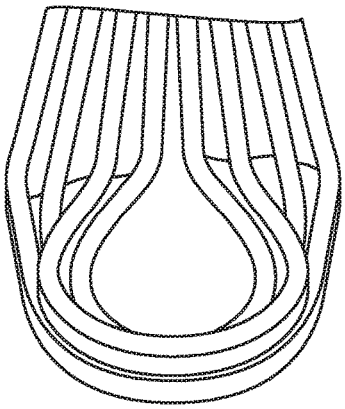

FIG. 6*b* shows an example of an MPE tubing according to the invention, in which the web-MPE has been twisted around its length axis before being bent, such that the web-MPE in the second straight section (C2) is twisted 180° in relation to the web-MPE in the adjacent first straight section (C1), and the individual tubes (8) in the first straight section (C1) have a sequence a-b-c-d before the bending zone and a sequence d-c-b-a after the bending zone. In this case the web-MPE has been bent around its height axis Z-Z, and the individual tubes were gathered before twisting and bending.

Figure 6C:
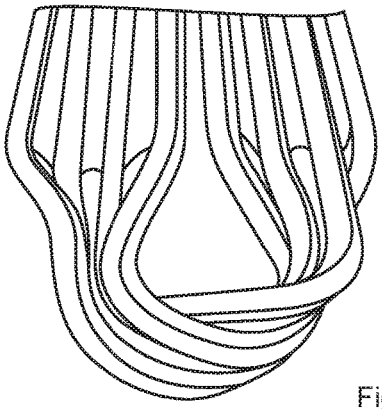

FIG. 6*c* shows another example of an MPE tubing according to the invention, in which the web-MPE has been twisted around its length axis before being bent, such that the web-MPE in the second straight section (C2) is twisted 180° in relation to the web-MPE in the adjacent first straight section (C1), and the individual tubes (8) in the first straight section (C1) have a sequence a-b-c-d before the bending zone and a sequence a-b-c-d after the bending zone. In this case the web-MPE has been bent around its height axis Z-Z and the individual tubes were gathered before twisting and bending.

An alternative way of manufacturing the Web-MPE is to twist the MPE tubing 180° and then bending it perpendicular to the extrusion direction.

In FIG. 7, a preferred design of the Web-MPE, before bending and sliding, is shown. The material of the interlinking web 9 between the tubes 8 of the MPE has been removed over some length 21 (FIG. 7*a*) and the tubes are gathered (FIG. 7*b*). This modification further makes it possible to twist the tubes before bending. The tubes a, b, c may be twisted, for instance 180° (FIG. 7*c*), before bending and then sliding of the parts relative each other (FIG. 7*d*). After manufacture, one or more of the flat MPE tubings may be assembled to a heat exchanger 20 of desired size by assembling the MPE tubings with fins 22 and headers 23, and then the heat exchanger may be brazed to tubing, in one or several alternating rows on top of each other, to form the final heat exchanger (see FIG. 8). Each MPE tubing 10 in the heat exchanger 20, is positioned at a distance $h_f$ from the adjacent MPE tubing, which is also the height of the row of fins. The width of each MPE tubing W1 is larger than the height of the row of fins.

FIG. 9 shows an alternative way of manufacturing a flat heat exchanger according to the invention. The MPE is here folded twice, first approximately 90° to the extrusion direction and then again 90° in the same direction, thus in total 180° whereby a folded MPE design (F) with individual tubes crossing each other twice is formed. The individual tubes (a-b-c-d) of the MPE will then be arranged in the reversed order (d-c-b-a) after the bending zone. The straight zones on each side of the bending zone will be on a distance B3 from each other, which is the distance center-to-center of the individual tubes closest to the adjacent straight zone. The distance B3 is preferably 0.01-1 mm.

Figure 10:
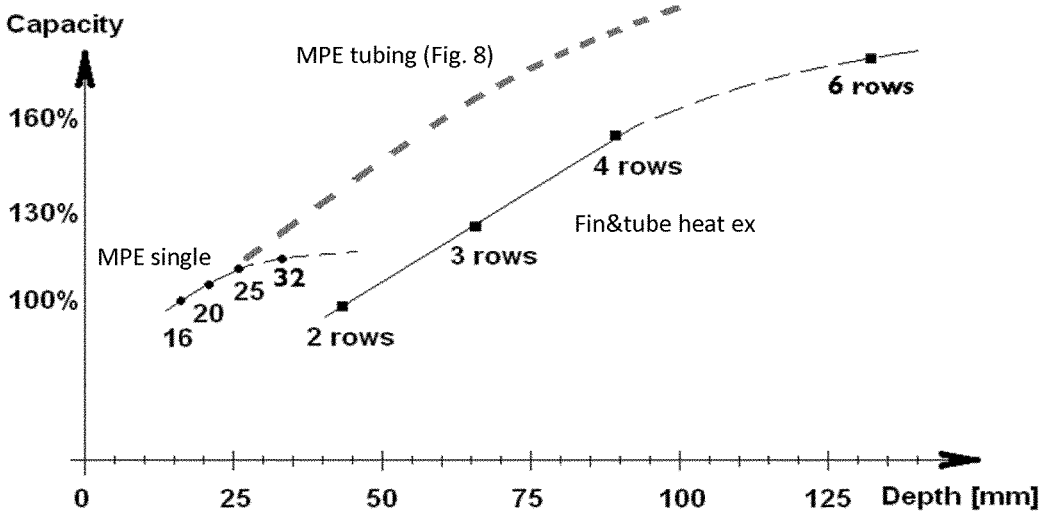
FIG. 10 shows a comparison of the cooling capacity of a condenser using the MPE in a counter flow arrangement according to the invention (dotted line) in comparison with parallel flow micro channel heat exchangers with depths from 16 mm to 32 mm and with single channel tube heat exchangers with 2-6 tube rows.

FIG. 10 shows a comparison of a heat exchanger according to the invention (shown in FIG. 8) with a heat exchanger of the type shown in FIG. 1 (MPE single), and a prior art fin & tube heat exchanger, where the fin & tube is a single tube heat exchanger, i.e. not an MPE. The cooling capacity of a condenser using the MPE tubing with a counter flow arrangement according to the invention is considerably improved in comparison with prior art heat exchangers, as is shown in FIG. 10. The Web-MPE based heat exchanger with a counter flow arrangement according to the invention shows the possibility of reaching higher cooling capacities in comparison with parallel flow MPE (i.e. non-serpentine) with depths from 16 mm to 32 mm, and capacities higher than those obtainable with single channel tube heat exchangers with 2-6 tube rows, for the same number of rows.

Figure 11:
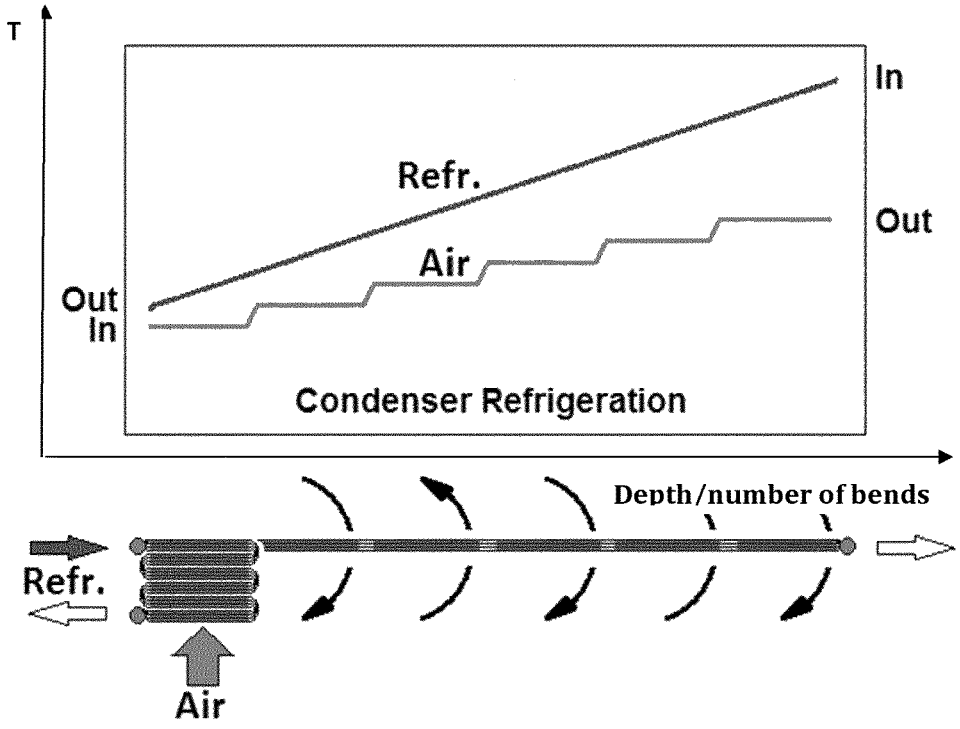
FIG. 11 shows the performance of the MPE tubing used as gas cooler in transcritical systems, such as in $CO_2$ gas coolers. A deeper heat exchanger provides a reduced temperature difference resulting in higher heat exchanger performance.

FIG. 11 shows the performance of the heat exchanger according to the invention used as gas cooler in trans-critical systems, such as in $CO_2$ gas coolers. Openings cut out in the bending zone allow easy and narrow bending along the width axis in order to allow counter flow/reduce the temperature to a minimum. It is evident from the figure that the capacity increases as the number of rows increases.

Figure 12:
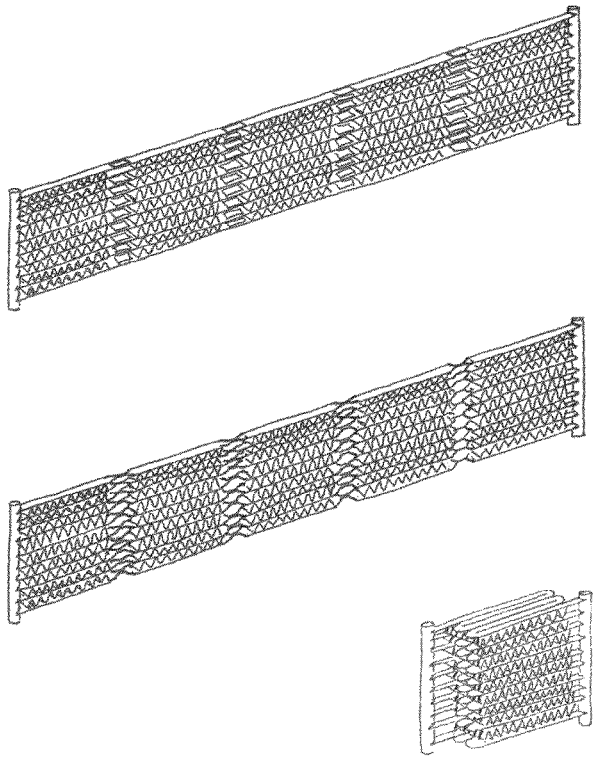
FIG. 12 shows bending of a parallel flow heat exchanger bent after brazing thereof.

Bending of a brazed heat exchanger comprising fins and tubes is also made possible due to cut outs or tears in the tubing, when these are made to overlap along the height of the heat exchanger. In this way the freedom of design increases additionally, see FIG. 12 where a long parallel flow heat exchanger having web-MPE's with webs partly or fully torn or punched away in the bending zone and having fins brazed between each row of MPEs are bent around the height axis after brazing in a serpentine fashion. The single tubes in the bending zones may be gathered before bending to ease deformation thereof. The heat exchanger may thus be made by a) tearing or removing parts of the web-MPE tube interlinking web (9) in a zone which will become the bending zone (A); b) assembling two or more web-MPE's with alternating rows of fins (22) and thereafter brazed to form a straight heat exchanger element, c) bending the heat exchanger element around the height axis (Z-Z) to form the bending zones (A).

The invention as defined in the claims is not limited to the examples as described above and shown in the figures. Thus, the heat exchanger can be used, not only as condenser, gas cooler or evaporator in a refrigeration system, but in any system where heat is exchanged or recovered by means of air or other fluid.

The invention claimed is:

1. A Multi Port Extrusion tubing (MPE tubing) (10) made from a Multi Port Extrusion (MPE), said MPE being a web like extrusion (Web-MPE) with two or more individual tubes (8) interlinked with webs (9), said webs having a thickness, which is less than the tube diameter of the individual tubes (8), and wherein the MPE tubing comprises at least one bending zone (A), and at least two straight zones (CI, C2), wherein webs (9) are partly torn or removed in the bending zone (A), and the web-MPE in the bending zone (A) is bent so that each individual tube (8) of the web-MPE has a U-shape, and that the web-MPE in a first straight zone (CI) is parallel to the web-MPE in an adjacent second straight zone (C2), the web-MPE in the straight zones (CI, C2) on each side of the bending zone (A) extend in substantially the same plane, so that all individual tubes (8) of the web-MPE in the straight zones are parallel to each other, and extend in the same plane, and the individual tubes in the at least one bending zone cross each other, and wherein the MPE tubing (10) has a height (ht) of <10 mm.

2. The MPE tubing according to claim 1, wherein the web-MPE in said straight zones (CI, C2) is positioned on each side of a line X-X extending along, and parallel to, the web-MPE in the straight zones, and wherein the innermost individual tube (8', 8") of each straight zone (CI, C2), which is closest to the line X-X, are in parallel relationship at a center-to-center distance B2 from each other, which distance B2 is approximately equal to, or less than, the diameter of the individual tubes, preferably 0.01-1 mm.

3. The MPE tubing according to claim 1, where the web-MPE has been twisted around its length axis (L) before being bent, such that the web-MPE in the second straight section (C2) is twisted 180° in relation to the web-MPE in the adjacent first straight section (CI), whereby the individual tubes (8) in the first straight section (CI) have a sequence a-b-c-d before the bending zone and a sequence d-c-b-a after the bending zone, or the individual tubes (8) in the first straight section (CI) have a sequence a-b-c-d before the bending zone and a sequence a-b-c-d after the bending zone.

4. An MPE tubing made from a Multi Port Extrusion (MPE), said MPE being a web like extrusion (Web-MPE) with two or more individual tubes (8) interlinked with webs (9), said webs having a thickness, which is less than the tube diameter of the individual tubes (8), and said webs (9) are partly torn or removed in the bending zone (A), the MPE tubing comprising:

at least one bending zone (A), and at least two straight zones (CI, C2), wherein the web-MPE in the bending zone (A) is bent 90° twice, the web-MPE thereby being bent in total 180° , so that the individual tubes cross each other twice in the bending zone; and the web-MPE in a first straight zone (CI) is parallel to the MPE in an adjacent second straight zone (C2); and the web-MPE in the straight zones (CI, C2) on each side of the bending zone (A) extend in substantially the same plane, so that all individual tubes (8) of the web-MPE in the straight zones are parallel to each other, and extend in the same plane.

5. A method of producing the MPE tubing according to claim 1, the method comprising:

a) tearing or removing parts of the web-MPE tube interlinking web (9) in a zone which will become the bending zone;

b) bending the web-MPE around its width axis (Y-Y) so that a U-shaped loop is formed having a straight upper part (CI) and a straight lower part (C2); and c) sliding the upper part (CI) of the bent web-MPE relative to the lower part (C2) so that the straight upper and lower parts of the web-MPE end up in parallel relationship and become located in the same plane, while the individual tubes (8) cross each other in the bending zone (A).

6. The method according to claim 5, wherein the steps a) and b) are repeated by bending the web-MPE in alternating opposite directions until a serpentine web-MPE comprising alternating straight zones and bending zones is formed.

7. The method of according to claim 5, wherein before step b) gathering of the individual tubes (8) in the zone, which will subsequently become the bending zone (A), so that the distance between the individual tubes is decreased, and then twisting the web-MPE 180° around its length axis.

8. A method of producing a MPE tubing according to claim 1, the method comprising:

a) tearing or removing parts of the web-MPE tube interlinking web (9) in a zone which will become the bending zone;

b) twisting the MPE tubing 180° around its length axis (L); and c) followed by bending it around the tube height axis (Z-Z).

9. A method of producing a MPE tubing according to claim 4, wherein forming a bending zone by folding the web-MPE approximately 90° to the extrusion direction, and then folding again approximately 90° in the same direction as the previous fold, so that the web-MPE is folded in total 180° , whereby a folded tube design (F) with individual tubes (8) crossing each other twice is formed.

10. The method according to claim 9, where the folding steps are repeated by bending the web-MPE in alternating opposite directions until a serpentine MPE tubing is formed, so that two or more bending zones are obtained.

11. A heat exchanger (20) comprising at least one MPE tubing (10) according to claim 1.

12. The heat exchanger of claim 11, further comprising fins (22) having a height (hf) attached to the MPE tubing (10), and where the MPE tubing has a width (W1), which is larger than the fin height (hf), preferably at least twice the fin height (hf).

13. A method of producing the heat exchanger according to claim 11, wherein the two or more MPE tubings (10) are produced as flat serpentines comprising at least one bending zone (A), and assembled with multiple alternating rows of fins (22) and thereafter brazed.

14. A method of producing the heat exchanger according to claim 11, the method comprising:

a) tearing or removing parts of the web-MPE tube interlinking web (9) in a zone which will become the bending zone (A);

b) assembling two or more web-MPE's with alternating rows of fins (22) and thereafter brazed to form a straight heat exchanger element; and c) bending the heat exchanger element around the height axis (Z-Z) in the bending zones (A).

* * * * *